US005584946A

United States Patent [19]

Karmaschek et al.

[11] Patent Number: 5,584,946

[45] Date of Patent: Dec. 17, 1996

[54] CHROMIUM-FREE CONVERSION COATING TREATMENT OF ALUMINUM

[75] Inventors: Uwe Karmaschek, Bergheim; Achim Roland, Solingen; Hubert Vennschott, Pforzheim-Buechenbronn; Harald Wennemann, Erkrath, all of Germany

[73] Assignee: Henkel Kommanditgesellschaft auf Aktien, Duesseldorf, Germany

[21] Appl. No.: 545,684

[22] PCT Filed: May 17, 1994

[86] PCT No.: PCT/EP94/01600

§ 371 Date: Nov. 22, 1995

§ 102(e) Date: Nov. 22, 1995

[87] PCT Pub. No.: WO94/28193

PCT Pub. Date: Dec. 8, 1994

[30] Foreign Application Priority Data

May 24, 1993 [DE] Germany ..... 43 17 217.2

[51] Int. Cl.[6] ..... C23C 22/78

[52] U.S. Cl. ..... 148/247; 148/254

[58] Field of Search ..... 148/247, 254

[56] References Cited

U.S. PATENT DOCUMENTS 4,191,596 3/1980 Dollman ..... 148/247

5,122,202 6/1992 Dykstra et al. ..... 148/247

5,294,266 3/1994 Hauffe ..... 148/247

5,449,414 9/1995 Dolar ..... 148/247

OTHER PUBLICATIONS

WO 92/07973 May 14, 1992.

*Primary Examiner*—Sam Silverberg

*Attorney, Agent, or Firm*—Ernest G. Szoke; Wayne C. Jaeschke; Norvell E. Wisdom, Jr.

[57] ABSTRACT

The invention concerns a method of pretreating aluminum or aluminum alloy surfaces before application of a permanent corrosion-protective conversion coating treatment, in particular before phosphating in acidic phosphating baths containing zinc, a chromating treatment, or a chromate free treatment. The method is characterized in that the surfaces are brought into contact with acidic aqueous treatment solutions containing complex fluorides of the elements boron, silicon, titanium, zirconium, or hafnium, alone or in mixtures with each other, at total concentrations between 100 and 4000 mg/L and at a pH between 0.3 and 3.5. Following the pretreatment, the aluminum or aluminum alloy parts may, after shaping if necessary, be joined by adhesive bonding and/or welding to each other or to parts made of steel, zinc plated and/or zinc alloy plated steel, and/or aluminum or aluminum alloy plated steel.

20 Claims, No Drawings

CHROMIUM-FREE CONVERSION COATING TREATMENT OF ALUMINUM

FIELD OF THE INVENTION

This invention relates generally to the chemical surface treatment of aluminum to protect it against corrosion, so-called passivation. More particularly, the invention relates to chromium-free treatment processes for aluminum strip and shaped aluminum parts to obtain temporary protection against corrosion without any deterioration in the weldability and bondability of the material or in its suitability for a further conversion step, for example phosphating, chromating or chromium-free conversion treatment.

"Aluminum" in the context of the invention is understood to be not only pure aluminum, but also alloys in which aluminum is the principal component. Examples of alloying elements frequently used are silicon, magnesium, copper, manganese, chromium and nickel, the total percentage by weight of these alloying elements in the alloy normally being no more than 10%.

STATEMENT OF RELATED ART

Aluminum is being increasingly used in vehicle manufacture for a number of reasons, including weight, stiffness and recyclability. Whereas engine and transmission parts, wheels, seat frames etc. are already being produced to a large extent from aluminum, the use of aluminum in bodywork is still confined to such pans as radiator hoods, rear lids, interior door pans and various small pans and to truck cabins, dropsides of transporters or superstructures of minivans. Worldwide, less than 5% of the total metal surface of automobile bodies is made of aluminum. The use of aluminum on a wider scale in this field is being intensively investigated by the aluminum and automobile industries.

The assembly of individual aluminum parts for vehicle construction is normally carried out by electrical resistance welding. According to Merkblatt DVS 2929 *"Widerstandsschweissien. Messung des Übergangswiderstandes an Aluminumwerkstoffen"* [Title in English: Resistance Welding. Measurement of the Electrical Resistance of Aluminum Materials), *Deutscher Verband für Schweisstechnik e.V.*, August 1985, this involves the following problems: "The affinity of aluminum for oxygen always leads to the formation of an oxide coating. The structure and thickness of this oxide coating have a major bearing on resistance welding. Thus, considerable significance is attributed to the surface treatment and to the resulting electrical contact resistance of the sheet metal parts both in regard to the reproducibility of the welding result and in regard to the amount of electrode. In the spot welding of untreated aluminum panels, the non-uniform and relatively large contact resistances are one of the main causes for non-uniformity of welding and for the small amounts of electrode. Surface treatments limit the contact resistance and make it substantially uniform over the entire surface of the parts to be joined."

For this reason, the material is pickled to remove the oxide coatings formed during transport and storage and to reduce the electrical surface resistance to the relatively low values required for welding and, at the same time, to make it uniform. Hitherto, this pickling step, for which acidic or alkaline aqueous solutions are used, has been carried out just before the welding process, mainly in component plants. The brief time interval between the two process steps is intended to suppress the renewed buildup of troublesome corrosion and soiling. By contrast, the chemical pretreatment of aluminum in coil plants, optionally followed by protective lacquering, is at present carried out only for those part which are not going on to be welded.

However, if aluminum is to be used on a wider scale in the mass production of motor vehicles, it would be preferable for the pickling step to be carried out either by the manufacturer or by the supplier of the aluminum strip. This would enable the chemical treatments of cleaning, pickling, rinsing, drying and oiling and the associated processes of wastewater treatment and disposal to be made more efficient, economical and ecologically safe. So-called "no-rinse" processes are particularly favorable from the point of view of waste management. In no-rinse processes, the treatment solutions are applied, for example, by roller ("chemcoater") and dried without any rinsing. These processes considerably reduce the consumption of chemicals and the effort involved in treating the rinsing water. However, they are only suitable for substrates with smooth surfaces, for example, metal strips.

Unfortunately, any chemical pretreatment on the part of the supplier entails the problem that, depending on the storage conditions (temperature, moisture, air contamination, time), the pickled aluminum surfaces become recoated with new non-specific, non-uniform and inorganically or organically contaminated oxide/hydroxide coatings. This uncontrolled change in the surface state and in the associated electrical surface resistance makes it impossible to maintain constant working conditions for such assembly techniques as welding and bonding.

According to the prior art, this problem could be solved by applying chromate-containing conversion coatings immediately after the pickling step. In conjunction with anti-corrosion oiling, these conversion coatings withstand long periods of storage (up to 6 months) without corrosion and without any loss of bondability. However, chromate-containing conversion coatings give rise to the following serious disadvantages in regard to the applications which have been discussed, making it difficult to use them for the application envisaged:

1. After forming, the aluminum parts are often ground to improve their fit. Toxic and carcinogenic chromium(VI)-containing compounds can occur in the grinding dust. Accordingly, measures to maintain safety in the workplace have to meet more stringent requirements.
2. In automobile manufacture, the aluminum parts pretreated with chromate are fitted together with parts of steel and/or galvanized steel to form a so-called multimetal body and are passed through the body pretreatment plant. In the typical alkaline cleaning step, soluble chromium(VI) compounds can be dissolved out from the coating. On the one hand, this affects the corrosion-inhibiting function of the coating; on the other hand, the chromate-containing cleaning solution has to be subjected to a special detoxification step before disposal.

The chromium-free conversion treatment of aluminum surfaces with fluorides of boron, silicon, titanium or zirconium either on their own or in conjunction with organic polymers for obtaining permanent protection against corrosion and for establishing a base for subsequent painting is known in principle:

U.S. Pat. No. 5,129,967 discloses, for the no-rinse treatment (described in the specification as "dried in place conversion coating") of aluminum, treatment baths containing:

a) 10 to 16 g/l of polyacrylic acid or homopolymers thereof,
b) 12 to 19 g/l of hexafluorozirconic acid,
c) 0.17 to 0.3 g/l of hydrofluoric acid and d) up to 0.6 g/l of hexafluorotitanic acid.

EP-B-8 942 discloses treatment solutions, preferably for aluminum cans, containing:

a) 0.5 to 10 g/l of polyacrylic acid or an ester thereof and b) 0.2 to 8 g/l of at least one of the compounds $H_2ZrF_6$, $H_2TiF_6$ and $H_2SiF_6$, the pH value of the solution being below 3.5, and an aqueous concentrate for regenerating the treatment solution containing a) 25 to 100 g/l of polyacrylic acid or an ester thereof, b) 25 to 100 g/l of at least one of the compounds $H_2ZrF_6$, $H_2TiF_6$ and $H_2SiF_6$ and c) a source of free fluoride ions which provides 17 to 120 g/l of free fluoride.

DE-C-19 33 013 discloses treatment baths with a pH value above 3.5 which, in addition to complex fluorides of boron, titanium or zirconium in quantities of 0.1 to 15 g/l, based on the metals, also contain 0.5 to 30 g/l of oxidizing agents, more particularly sodium metanitrobenzene sulfonate.

DE-C-24 33 704 describes treatment baths for increasing paint adhesion and permanent corrosion protection on inter alia aluminum which may contain 0.1 to 5 g/l of polyacrylic acid or salts or esters thereof and 0.1 to 3.5 g/l of ammonium fluozirconate, expressed as $ZrO_2$. The pH values of these baths may vary over a wide range. The best results are generally obtained at pH values of 6 to 8.

U.S. Pat. No. 4,992,116 describes, for the conversion treatment of aluminum, treatment baths with pH values in the range from about 2.5 to 5 which contain at least three components:

a) phosphate ions in a concentration of $1.1\times10^{-5}$ to $5.3\times10^{-3}$ moles/l, corresponding to 1 to 500 mg/l, b) $1.1\times10^{-5}$ to $1.3\times10^{-3}$ moles/l of a fluoro acid of an element from the group consisting of Zr, Ti, Hf and Si (corresponding to between 1.6 and 380 mg/l according to the element) and c) 0.26 to 20 g/l of a polyphenol compound obtainable by reaction of poly(vinylphenol) with aldehydes and organic amines.

A molar ratio of about 2.5:1 to about 1:10 has to be maintained between the fluoro acid and the phosphate.

DE-A-27 15 292 discloses, for the chromium-free pretreatment of aluminum cans, treatment baths which contain at least 10 ppm of titanium and/or zirconium, between 10 and 1000 ppm of phosphate and a sufficient quantity of fluoride for the formation of complex fluorides of the titanium and/or zirconium present, but at least 13 ppm, and which have pH values in the range from 1.5 to 4.

WO 92/07973 teaches a chromium-free treatment process for aluminum in which 0.01 to around 18% by weight of $H_2ZrF_6$ and 0.01 to around 10% by weight of a 3-(N-$C_{1-4}$-alkyl-N-2-hydroxyethylaminomethyl)-4-hydroxystyrene polymer are used as the key components in the form of an acidic aqueous solution. Optional components are 0.05 to 10% by weight of dispersed $SiO_2$, 0.06 to 0.6% by weight of a solubilizer for the polymer, and surfactant. The polymer mentioned belongs to the group of "reaction products of poly(vinylphenol) with aldehydes and organic hydroxyfunctional amines" described below which may be used for the purposes of the present invention.

These known treatment baths were developed to obtain permanent protection against corrosion, optionally in conjunction with good paint adhesion. The criteria of phosphatability and the low welding resistance required were not considered.

DESCRIPTION OF THE INVENTION

Object of the Invention

By contrast, the problem addressed by the present invention, but never in the prior art, was to provide a chromium-free process for the pretreatment of surfaces of aluminum or its alloys which would enable these surfaces to be subsequently treated by known conversion processes to obtain permanent protection against corrosion, optionally after intermediate mechanical treatment steps, for example forming or assembly, and/or physicochemical steps, such as cleaning and rinsing. The conversion processes in question for obtaining permanent protection against corrosion include, in particular, phosphating with acidic zinc-containing phosphating baths, chromating, or a chromium-free conversion treatment corresponding to the literature cited above, for example with reactive organic polymers and/or with compounds, more particularly fluoro complexes, of the elements titanium, zirconium and/or hafnium. The pretreatment according to the invention must guarantee temporary protection against corrosion over a prolonged storage time, for example two to three months, without adverse effects either on the bondability of material or on its weldability, for example by electrical resistance welding. For resistance welding, the electrical surface resistance should be uniform and should not exceed a value of around 400 μohms, preferably being below about 100 μohms. By contrast, after alkaline pickling and subsequent storage for 4 weeks, the electrical surface resistance values show very considerable local variations and cover a range from 100 to 1500 μohms. The surface resistance is measured in accordance with the above-cited Merkblatt DVS 2929 in the form of an individual plate measurement using iron electrodes 20 mm in diameter.

Another requirement which the coating has to meet is that, after they have been assembled to form a multimetal body, the correspondingly coated parts should be covered with a permanently corrosion-inhibiting zinc phosphate coating during the now standard multimetal pretreatment of the body in the automobile manufacturing plant which consists at least of the following process steps: cleaning, rinsing, zinc phosphating, rinsing, rinsing with deionized water. A multimetal body is a body made from at least two of the materials aluminum, steel, galvanized steel, alloy-galvanized steel, aluminized steel or alloy-aluminized steel. Suitable multimetal phosphating processes are known to persons skilled in the art of conversion treatment, for example from DE-A-39 18 136 and EP-A-106 459 and are not the subject of the present invention. Alternatively, in the case of an all-aluminum body, other permanently corrosion-inhibiting conversion treatments may be applied and should not be impeded in any way by the first conversion step according to the invention. Corresponding conversion treatments include, for example, chromating with Cr(VI)- and/or Cr(III)-containing treatment baths and the chromium-free conversion processes mentioned above.

DESCRIPTION OF THE INVENTION AND PREFERRED EMBODIMENTS THEREOF

This problem has been solved by initially subjecting surfaces of aluminum or aluminum alloys to acidic or alkaline cleaning and rinsing in accordance with the prior art. According to the invention, this is followed by the application of a thin conversion coating which consists of (mixed) oxides, (mixed) fluorides and/or oxyfluorides of aluminum and at least one of the elements boron, silicon, titanium, zirconium or hafnium and which may be modified with organic polymers from the class of polyacrylates, including acrylate-containing copolymers, or reaction products of poly(vinylphenol) with aldehydes and organic hydroxyfunctional amines. The feature "thin" is to be understood to mean that the concentration of the layer-forming elements boron, silicon, titanium, zirconium and/or hafnium on the aluminum surface together amounts to between 1 and 80 $mg/m^2$ and, more particularly, to between 2 and 20 $mg/m^2$. The polymer content of the conversion coating should not exceed 5 $mg/m^2$ and is preferably between 0 and 3 $mg/m^2$.

Accordingly, the present invention relates to a process for the pretreatment of surfaces of aluminum or its alloys before a second, permanently corrosion-preventing conversion treatment, preferably chromating, a chromium-free conversion treatment with reactive organic polymers and/or with compounds of the elements titanium, zirconium and/or hafnium, or phosphating with acidic zinc-containing phosphating baths, characterized in that the surfaces are contacted with acidic aqueous treatment solutions which contain complex fluorides of the elements boron, silicon, titanium, zirconium or hafnium either individually or in admixture with one another in concentrations of the fluoro anions of, in all, 100 to 4000 mg/l and preferably 200 to 2000 mg/l and which have a pH value of 0.3 to 3.5 and preferably in the range from 1 to 3.

The treatment solutions may additionally contain polymers from the class of polyacrylates and/or reaction products of poly(vinylphenol) with aldehydes and organic hydroxyfunctional amines in concentrations below 500 mg/l and preferably below 200 mg/l. If the treatment solution contains Zr, the concentration of the reaction products or poly(vinylphenol) with aldehydes and organic hydroxyfunctional amines should be less than 100 mg/l.

Other potential components of the treatment baths are free fluoride ions in concentrations of up to 500 mg/l and polyhydroxycarboxylic acids or anions thereof, more particularly gluconate ions, in concentrations of up to 500 mg/l.

The complex fluorides of the elements boron, silicon, titanium, zirconium or hafnium, i.e. the anions $BF_4^-$, $SiF_6^{2-}$ $TiF_6^{2-}$ $ZrF_6^{2-}$ or $HfF_6^{2-}$, may be introduced in the form of the free acids or as salts. Suitable counterions are, in particular, alkali metal and ammonium ions. The same also applies to the optional components free fluoride and polyhydroxycarboxylic acids. If these components are not, or not exclusively, used in the form of the acids, the pH of the treatment baths may have to be adjusted to a value in the range according to the invention from 0.3 to 3.5. Phosphoric acid, nitric acid and sulfuric acid are particularly suitable for this purpose. The pH of the treatment solution is preferably adjusted to a value of 1 to 3. Depending on the substrate, the presence of sulfate ions in the treatment bath in concentrations of up to 5% by weight and, more particularly, between 0.1 and 3% by weight can be an advantage.

Polymers of the acrylate type, including acrylate-containing copolymers, which are suitable as optional additives in concentrations below 500 mg/l, are known as commercial products in the prior art. Particularly suitable optional additives are water-soluble polyacrylic acids with molecular weights in the range from 20,000 to 100,000 daltons, more particularly those having an average molecular weight in the range from about 50,000 to 60,000 daltons and a pH value—in the form of a 5% by weight aqueous solution—of the order of 2.

Suitable polymers belonging to the class of reaction products of polyvinylphenol with aldehydes and organic amines are known as agents for the surface treatment of metals and, more particularly, for the passivating after-rinsing of conversion-treated metal surfaces, for example from EP-A-319 016 and from EP-A-319 017. The polymers in question have molecular weights of up to 2,000,000 daltons and preferably in the range from 7,000 to 70,000 daltons. In the chains, the optionally substituted phenol rings may be attached by one or two carbon atoms, the chains optionally having been subjected to a post-crosslinking process. Characteristically, a nitrogen atom bearing another alkyl substituent with at least one hydroxyfunction is attached to at least part of the phenol rings by a carbon atom. This structure provides the polymer with chelating properties with respect to metal ions.

In the conversion treatment art, it is standard practice not to prepare the treatment baths by mixing the individual components together in situ in the required concentrations, but instead to use preformed concentrates to prepare the baths by dilution with water. Accordingly, the present invention also relates to aqueous concentrates which form the treatment solutions described above by dilution with water to 0.5 to 10% by volume.

The treatment solutions should have temperatures in the range from 15° to 60° C. and may be applied to the aluminum surfaces by spraying, immersion or by the no-rinse method. Where the treatment solutions are applied by spraying or immersion, the necessary treatment times are between 5 and 90 seconds. In the no-rinse process, which may be carried out for example by roller (so-called chem-coater), the establishment of a certain wet film thickness by squeezing rollers is a relevant step. The wet film thickness should be between 2 and 10 $ml/m^2$ and is preferably between 4 and 6 $ml/m^2$.

Whereas, by definition, there is no rinsing step after the no-rinse treatment, both the immersion treatment and the spray treatment may optionally be followed by rinsing with deionized water having a temperature of 10° to 40° C.

Irrespective of the method of application, it is of advantage to dry the aluminum surfaces after the treatment at temperatures in the range from 40° to 85° C.

Since the described pretreatment process according to the invention comes at the beginning of the treatment chain of pretreatment—optionally forming—assembly (=bonding or welding)—conversion treatment—painting, it should be viewed in a functional connection with the following steps. It is therefore within the scope of the invention that:

a) the parts of aluminum or its alloys are subjected to forming and/or machining between the pretreatment of the surfaces of aluminum or its alloys and the permanently corrosion-preventing conversion treatment—more particularly phosphating with acidic zinc-containing phosphating baths, chromating or a chromium-free conversion treatment—and/or b) the parts of aluminum or its alloys are joined to one another or to parts of steel and/or galvanized steel and/or alloy-galvanized steel and/or aluminized steel and/or alloy-aluminized steel by bonding and/or by welding, more particularly by electrical resistance welding, between the pretreatment of the surfaces of aluminum or its alloys and the permanently corrosion-preventing conversion treatment -more particularly phosphating with acidic zinc-containing phosphating baths, chromating, or a chromium-free conversion treatment—and/or c) cleaning and/or pickling steps, rinsing with water and/or with activating rinsing baths are carried out between the pretreatment of the surfaces of—aluminum or its alloys and the permanently corrosion-preventing conversion treatment—more particularly phosphating with acidic zinc-containing phosphating baths, chromating or a chromium-free conversion treatment.

EXAMPLES 1.1 mm thick aluminum plates measuring 100×200 mm, of various alloys from the AA 6000 group from various manufacturers and of varying age (cf. Table were freed from the anti-corrosion oil by treatment for 10–12 s at 65° C. with a 1% aqueous alkaline cleaning solution (Ridoline® C 72, Henkel KGaA) and then rinsed with process water for 5 s at room temperature and then with deionized water for 5 s at room temperature. The plates were then subjected to the conversion treatment with treatment solutions according to the invention and comparison solutions according to Table 1 applied by the methods according to Table 2, namely immersion, spraying or centrifuging (simulation of application by chemcoater=no-rinse). After centrifuging in a paint centrifuge at 550 revolutions per minute, which gives a wet film thickness of 5 to 6 μm for a throwing time of 5 seconds, the samples were immediately dried for 10 minutes at 70° C. in a drying cabinet. The sample plates treated by spraying or immersion were then rinsed with gentle movement for 5 seconds in deionized water and subsequently dried. The conductivity of the water running off after the final rinse with deionized water should not exceed 20 μS. The surface resistance is a measure of good spot weldability. It is determined in accordance with *DVS Merkblatt* 2929 (*Deutscher Verband für Schweisstechnik,* Stand August 85). The single-plate method described in *Merkblatt* 2929 was used (electrode force: 75 KN, current intensity: 20 A). The resistance values shown in Table 2 are already minus the zero value (electrodes on top of one another). Table 2 shows the resistance values after various storage times (1 day, 30 days, 60 days).

As an example of a permanently corrosion-preventing conversion treatment, the "overphosphatability" of the treated samples was tested as follows: the plates temporarily corrosion-protected by the pretreatment process according to the invention and comparison processes were subjected to the following process steps:

| | |
|---|---|
| 1. Cleaning: | alkaline cleaner Ridoline ® C 1250 I (Henkel KGaA), 2%, 55° C., 3 mins. |
| 2. Rinsing | in Cologne tap water |
| 3. Activation: | activating agent containing titanium phosphate Fixodine ® L (Henkel KGaA), 1% in deionized water, RT, 45 s |
| 4. Phosphating: | trication phosphating process Granodine ® 958 G (Henkel KGaA) according to EP-A-106 459 with operating parameters corresponding to the operating instructions, free acid 1.0–1.1, total acid 20.4, Zn 1.11 g/l, toner ($NO_2^-$) 1.8–2.0 points, free fluoride 600 ppm, 52° C., 3 mins |
| 5. Rinsing | in tap water, RT, 20 s |
| 6. Rinsing | in deionized water, RT, 20 s |
| 7. Drying | with compressed air |

Visual evaluation of all the phosphated surfaces after passivation in accordance with the invention revealed a light grey, uniform and firm phosphate coating. This was confirmed by viewing magnifications in an X-ray electron microscope.

As the Examples show, the results obtained are dependent upon the alloy selected and upon the previous history of the material (storage time). In general, better results were obtained with the alloy AC120. However, in all cases of the conversion treatment according to the invention, the results obtained in regard to surface resistance and phosphatability lie within the technically necessary limits.

By contrast, the samples treated with comparison solutions show distinct deviations: An increase in the polymer concentration (Comp. 1) leads to high surface resistances and to the loss of phosphatability. If the concentration of complex fluorides is reduced below the minimum concentration according to the invention (Comp. 2 and 3), phosphatability is maintained although the surface resistances increase considerably with the storage time and show significant variations. Although an increase in the concentration of the complex fluorides beyond the range according to the invention (Comp. 4) leads to surface resistances which show only a slight increase with the storage time, they are generally too high. In addition, phosphatability is adversely affected. Comparison Example 5 shows the negative influence of an excessive phosphate concentration on the surface resistance.

Bondability was tested by tensile shear tests according to DIN 53283 using a commercially available 2-component epoxy adhesive (Terokal® 5045, a product of Teroson GmbH, Heidelberg) in accordance with the manufacturer's instructions. The alloy AC 120 was used as the substrate, being treated by the process according to Table 2 and then stored in the open for 30 days. There was no further pretreatment before determination of bond strength. For comparison, the values for a sample which had only been degreased and for a green-chromated sample were measured after the same storage time. The results are set out in Table 3.

TABLE 1

| | Conversion processes; bath concentrations in mg/l | | | | | | | | | | |
|---|---|---|---|---|---|---|---|---|---|---|---|
| Test No. | $TiF_6^{2-}$ | $ZrF_6^{2-}$ | $BF_4^-$ | $SiF_6^{2-}$ | HF | Polymer[1)] | $H_3PO_4$ | $HNO_3$ | $H_2SO_4$ | Gluconate | pH |
| Example 1 (E1) | 780 | — | — | — | 135 | — | 675 | — | — | 450 | 3.0 |
| Example 2 (E2) | 780 | — | 100 | — | 50 | — | 650 | — | — | 500 | 2.7 |
| Example 3 (E3) | — | 1000 | — | — | — | A, 100 | — | — | — | — | 2.5 |
| Example 4 (E4) | — | 1000 | — | — | — | B, 80 | — | — | — | — | 2.5 |
| Example 5 (E5) | — | 2000 | — | — | 280 | — | — | — | — | — | 2.0 |
| Example 6 (E6) | — | 800 | — | 200 | — | — | — | — | — | — | 2.5 |
| Example 7 (E7) | 2700 | — | — | — | 140 | — | — | — | — | — | 2.0 |
| Example 8 (E8) | — | 600 | — | — | 70 | — | — | 1600 | — | 300 | 1.7 |
| Example 9 (E9) | 1000 | — | — | — | — | — | — | — | — | — | 2.6 |

TABLE 1-continued

| Test No. | Conversion processes; bath concentrations in mg/l | | | | | | | | | | |
|---|---|---|---|---|---|---|---|---|---|---|---|
| | $TiF_6^{2-}$ | $ZrF_6^{2-}$ | $BF_4^-$ | $SiF_6^{2-}$ | HF | Polymer[1)] | $H_3PO_4$ | $HNO_3$ | $H_2SO_4$ | Gluconate | pH |
| Example 10 (E10) | 1000 | — | — | — | — | — | — | — | 5000 | — | 1.3 |
| Example 11 (E11) | 1000 | — | — | — | — | — | — | — | 10000 | — | 1.0 |
| Example 12 (E12) | 1000 | — | — | — | — | — | — | — | 30000 | — | 0.5 |
| Example 13 (E13) | — | 1000 | — | — | — | — | — | — | — | — | 2.6 |
| Example 14 (E14) | 1000 | — | — | — | — | A, 100 | — | — | — | — | 2.5 |
| Example 15 (E15) | 1000 | — | — | — | — | B, 100 | — | — | — | — | 2.5 |
| Comp. 1 (C1) | — | 1000 | — | — | — | A, 1000 | — | — | — | — | 2.5 |
| Comp. 2 (C2) | 50 | — | — | — | — | — | — | 100 | — | — | 2.8 |
| Comp. 3 (C3) | — | — | — | — | — | A, 100 | — | 200 | — | — | 2.5 |
| Comp. 4 (C4) | — | 6000 | — | — | 280 | — | — | — | — | — | 2.0 |
| Comp. 5 (C5) | — | 2000 | — | — | — | — | 800 | — | — | — | 2.3 |
| Comp. 6 (C6) | — | — | — | — | — | — | — | — | 10000 | — | 1.0 |

[1)]Polymers:
A: Water-soluble polyacrylic acid, average molecular weight 50,000
B: Reaction product of poly(4-vinylphenol) with formaldehyde and N-methyl glucamine according to EP-A-319 016; average molecular weight 40,000

TABLE 2

| Sample | Application | Method of application, electrical surface resistance[1)] (μohms) and phosphatability after 30 days | | | | |
|---|---|---|---|---|---|---|
| | | Temperature (time) | Resistance after 1 day | 30 days | 60 days | Phosphatability[3)] |
| E1, a[2)] | Immersion | 60° C. | 115–140 | 100–200 | 400–500 | o |
| E1, b[2)] | | (8 secs.) | 100–300 | 130–350 | 400–500 | o |
| E1, c[2)] | | | 30–50 | 90–180 | 400–500 | + |
| E2, a | Immersion | 60° C. | 100–150 | 150–200 | 300–400 | o |
| E2, b | | (8 secs.) | 90–250 | 100–300 | 300–400 | o |
| E2, c | | | 30–50 | 80–150 | 250–400 | + |
| E3, a | No- | 20° C. | 30–45 | 50–80 | 80–100 | o |
| E3, b | rinse | | 40–80 | 40–60 | 80–160 | + |
| E3, c | | | 10–15 | 30–35 | 70–110 | + |
| E4, a | No- | 20° C. | 30–40 | 50–80 | 90–120 | + |
| E4, b | rinse | | 30–60 | 40–70 | 80–150 | + |
| E4, c | | | 10–15 | 20–30 | 70–120 | + |
| E5, a | No- | 20° C. | 40–50 | 45–85 | 100–160 | + |
| E5, b | rinse | | 20–25 | 40–80 | 75–90 | + |
| E5, c | | | 4–7 | 15–20 | 50–70 | + |
| E6, a | No- | 20° C. | 30–45 | 50–85 | 80–150 | + |
| E6, b | rinse | | 20–50 | 35–60 | 70–130 | + |
| E6, c | | | 10–15 | 20–30 | 50–80 | + |
| E7, a | Spraying | 45° C. | 120–200 | 150–250 | 200–300 | o |
| E7, b | | (60 secs.) | 120–180 | 160–240 | 200–300 | o |
| E7, c | | | 100–150 | 150–200 | 200–250 | + |
| E8, a | Immersion | 45° C. | 60–100 | 80–120 | 250–500 | + |
| E8, b | | (5 secs.) | 50–100 | 130–180 | 200–500 | + |
| E8, c | | | 10–25 | 20–55 | 75–100 | + |
| E9, c | Spraying | 40–45° C. | 15–25 | 20–30 | 20–30 | + |
| E9, b | | (25 secs.) | 20–30 | 30–40 | 30–40 | + |
| E10, c | Spraying | 40–45° C. | 10–20 | 10–20 | 10–20 | + |
| E10, b | | (25 secs.) | 15–20 | 15–25 | 15–25 | + |
| E11, c | Spraying | 40–45° C. | 5–10 | 5–10 | 3–10 | + |
| E11, b | | (25 secs.) | 10–15 | 10–20 | 10–20 | + |
| E12, c | Spraying | 40–45° C. | 3–10 | 3–10 | 3–10 | + |
| E12, b | | (25 secs.) | 10–15 | 15–25 | 15–25 | + |
| E13, a | No- | 20° C. | 24–30 | 40–55 | 70–80 | + |
| E13, b | rinse | | 25–40 | 50–80 | 55–80 | + |
| E13, c | | | 4–7 | 20–30 | 75–85 | + |
| E14, c | No- | 20° C. | 20–25 | 30–40 | 70–100 | + |
| E14, b | rinse | | 40–70 | 40–80 | 80–160 | + |
| E15, c | No- | 20° C. | 15–25 | 25–40 | 60–100 | + |
| E15, b | rinse | | 30–50 | 35–70 | 70–140 | + |
| C1, a | No- | 20° C. | 500–800 | 600–800 | 700–1000 | – |
| C1, b | rinse | | 400–700 | 500–800 | 600–900 | – |
| C1, c | | | 400–600 | 500–700 | 500–700 | – |
| C2, a | Immersion | 60° C. | 100–300 | 500–1000 | 600–1000 | + |
| C2, b | | (8 secs.) | 80–200 | 200–900 | 400–1000 | + |
| C2, c | | | 40–60 | 200–1000 | 300–1000 | + |
| C3, a | Immersion | 60° C. | 80–200 | 300–1200 | 400–1200 | + |
| C3, b | | (8 secs.) | 50–150 | 200–1000 | 300–1100 | + |

TABLE 2-continued

| Sample | Application | Temperature (time) | Resistance after 1 day | 30 days | 60 days | Phosphatability[3)] |
|---|---|---|---|---|---|---|
| | | Method of application, electrical surface resistance[1)] (μohms) and phosphatability after 30 days | | | | |
| C3, c | | | 30–70 | 100–700 | 300–900 | + |
| C4, a | No- | 20° C. | 500–700 | 600–900 | 700–1000 | – |
| C4, b | rinse | | 500–800 | 600–950 | 700–1000 | o |
| C4, c | | | 400–700 | 500–900 | 650–900 | o |
| C5, c | No-rinse | 20° C. | 700–1000 | 700–1000 | 700–1000 | + |
| C6, c | Spraying | 40–45° C. | 10–20 | 100–150 | 300–700 | + |
| C6, b | | (25 secs.) | 10–15 | 90–130 | 300–800 | + |

[1)]As measured in accordance with DVS Merkblatt 2929, single-plate measurement, iron electrodes 20 mm in diameter
[2)]Alloys of group AA 6016 used
a: T 6009, manufacturer Alcoa; stored for >12 months
b: T 6009, manufacturer Alcoa; stored for 3 months
c: AC 120, manufacturer Alusuisse; new material
[3)]Phosphatability (scanning electron micrographs)
+: continuous finely crystalline phosphate coating
o: continuous, coarse phosphate coating
–: phosphate coating non-continuous or non-existent

TABLE 3

| Sample | Tensile shear strength (MPa) |
|---|---|
| | Tensile shear strengths (overlap: 25 × 12 mm) |
| E2c | 12.3 |
| E3c | 13.5 |
| E6c | 11.5 |
| E7c | 12.8 |
| E11c | 13.2 |
| E13c | 14.2 |
| E14c | 12.0 |
| Degreased | 15.5 |
| Green-chromated | 12.0 |

The invention claimed is:

1. A process for treatment of surfaces of aluminum and its alloys, said process comprising steps of:

(I) treating the surfaces by contacting them with acidic aqueous treatment solutions which contain complex fluorides of the elements boron, silicon, titanium, zirconium or hafnium individually or in admixture with one another in concentrations of the fluoro anions of, in all, 100 to 4000 mg/l and which have a pH value of 0.3 to 3.5;

(II) subjecting the thus treated surfaces to machining, forming, or joining to one another or to parts of steel, galvanized steel, or alloy-galvanized steel by bonding or by welding; and (III) subjecting the machined, formed, or joined surfaces produced in step (II) to a permanently corrosion-preventing conversion treatment.

2. A process as claimed in claim 1, wherein the treatment solutions used in step (I) contain polymers selected from the group consisting of polyacrylates and reaction products of poly(vinylphenol) with aldehydes and organic hydroxyfunctional amines in concentrations below 500 mg/l, and, where zirconium is present in the treatment solution, the concentration of reaction products of poly(vinylphenol) with aldehydes and organic hydroxyfunctional amines is less than 100 mg/l.

3. A process as claimed in claim 2, wherein the treatment solutions used in step (I) additionally contain free fluoride ions in concentrations of up to 500 mg/l.

4. A process as claimed in claim 3, wherein the treatment solutions used in step (I) contain gluconate ions in concentrations of up to 500 mg/l.

5. A process as claimed in 4, wherein the treatment solutions used in step (I) additionally contain sulfate ions in concentrations between 1 and 30 g/l.

6. A process as claimed in claim 1, wherein the treatment solutions used in step (I) have temperatures of 15° to 60° C. and are applied to the aluminum surfaces by spraying, immersion or by a no-rinse method.

7. A process as claimed in claim 6, wherein the aluminum surfaces are dried at temperatures of 40° to 85° C. after treatment step (I).

8. A process as claimed in claim 1, wherein cleaning steps and rinsing with water or with activating or passivating rinsing baths are carried out between steps (II) and (III) of the process.

9. A process according to claim 1, wherein the pH of the treatment solution used in step (I) is from 1 to 3 and the permanently corrosion-preventing corrosion treatment of step (III) is selected from the group consisting of (i) chromating; (ii) a chromium-free conversion treatment (ii.1) with reactive organic polymers, (ii.2) with a compound of at least one of titanium, zirconium and hafnium, or (ii.3) with both reactive organic polymers and a compound of at least one of titanium, zirconium, and hafnium; and (III) phosphating with an acidic zinc-containing phosphating bath.

10. A process as claimed in claim 9, wherein the treatment solutions used in step (I) contain polymers selected from the group consisting of polyacrylates and reaction products of poly(vinylphenol) with aldehydes and organic hydroxyfunctional amines in concentrations below 200 mg/l and, where zirconium is present in the treatment solution, the concentration of the reaction products of poly(vinylphenol) with aldehydes and organic hydroxyfunctional amines is less than 100 mg/l.

11. A process as claimed in claim 1, wherein the treatment solutions used in step (I) contain polymers selected from the group consisting of polyacrylates and reaction products of poly(vinylphenol) with aldehydes and organic hydroxyfunctional amines in concentrations below 200 mg/l and, where zirconium is present in the treatment solution, the concentration of the reaction products of poly(vinylphenol) with aldehydes and organic hydroxyfunctional amines is less than 100 mg/l.

12. A process as claimed in claim 1, wherein the treatment solutions used in step (I) additionally contain free fluoride ions in concentrations of up to 500 mg/l.

13. A process as claimed in claim 1, wherein the treatment solutions used in step (I) contain polyhydroxycarboxylic acids or anions thereof in concentrations of up to 500 mg/l.

14. A process as claimed in claim 13, wherein the treatment solutions used in step (I) additionally contain sulfate ions in concentrations between 1 and 30 g/l.

15. A process as claimed in claim 12, wherein the treatment solutions used in step (I) additionally contain sulfate ions in concentrations between 1 and 30 g/l.

16. A process as claimed in claim 11, wherein the treatment solutions used in step (I) additionally contain sulfate ions in concentrations between 1 and 30 g/l.

17. A process as claimed in claim 10, wherein the treatment solutions used in step (I) additionally contain sulfate ions in concentrations between 1 and 30 g/l.

18. A process as claimed in claim 9, wherein the treatment solutions used in step (I) additionally contain sulfate ions in concentrations between 1 and 30 g/l.

19. A process as claimed in claim 3, wherein the treatment solutions used in step (I) additionally contain sulfate ions in concentrations between 1 and 30 g/l.

20. A process as claimed in claim 1, wherein the treatment solutions used in step (I) additionally contain sulfate ions in concentrations up to 30 g/l.

* * * * *